US007198273B1

(12) United States Patent
Advocate

(10) Patent No.: US 7,198,273 B1
(45) Date of Patent: Apr. 3, 2007

(54) TOSSING GAME SYSTEM AND METHOD

(75) Inventor: Wayne E. Advocate, Mohave Valley, AZ (US)

(73) Assignee: William Hicks, Upland, CA (US)

( * ) Notice: Subject to any disclaimer, the term of this patent is extended or adjusted under 35 U.S.C. 154(b) by 7 days.

(21) Appl. No.: 11/221,313

(22) Filed: Sep. 7, 2005

Related U.S. Application Data

(63) Continuation-in-part of application No. 10/742,716, filed on Dec. 19, 2003, now abandoned.

(51) Int. Cl.
*A63B 67/00* (2006.01)

(52) U.S. Cl. ..... 273/343; 273/348

(58) Field of Classification Search ..... 273/343, 273/398, 399, 400, 401, 402; 473/197, 454, 473/455, 456, 477
See application file for complete search history.

(56) References Cited

U.S. PATENT DOCUMENTS 3,701,531 A 10/1972 Bowers
3,717,348 A 2/1973 Bowers
3,981,501 A 9/1976 Gonmzales et al.
4,487,419 A 12/1984 Welbourn
5,165,964 A 11/1992 Kraushaar
5,330,199 A 7/1994 Vand
5,522,597 A 6/1996 Hanks
5,539,957 A 7/1996 Schmidt
5,645,140 A 7/1997 Mouneimneh
5,938,203 A 8/1999 Beckwith, Sr.
6,308,956 B1 10/2001 Reid
D478,938 S 8/2003 Vande Hey et al.
6,773,014 B2 8/2004 Lynch
6,773,015 B2 8/2004 Long et al.
2002/0084588 A1 7/2002 Lynch
2003/0098545 A1 5/2003 Webb

*Primary Examiner*—Nini F. Legesse
(74) *Attorney, Agent, or Firm*—Eric Karich

(57) ABSTRACT

A target is disclosed for use in a tossing game. The target includes a base and a collapsible ladder assembly hingedly connected to the base. The ladder assembly includes a pair of telescoping vertical members and multiple horizontal rungs connected therebetween. A described tossing game system includes a pair of such targets.

4 Claims, 4 Drawing Sheets

TOSSING GAME SYSTEM AND METHOD

CROSS-REFERENCE TO RELATED APPLICATIONS

This application for a utility patent is a continuation-in-part of a previously filed utility patent, now abandoned, having the application Ser. No. 10/742,716, filed Dec. 19, 2003.

STATEMENT REGARDING FEDERALLY SPONSORED RESEARCH

Not Applicable

BACKGROUND OF THE INVENTION

1. Field of the Invention

This invention relates generally to recreational games, and more particularly to tossing game systems and methods.

2. Description of Related Art

Tossing games, such as horse shoes and ring toss, are well known forms of amusement that are often enjoyed in parks, beaches, etc. One of the benefits of these tossing games is that they tend to be small and lightweight components that can be readily taken on these types of social outings.

Another form of tossing game, described in Lynch, U.S. Pat. No. 6,773,014, teaches tossing flexible projectiles and attempting to hang the projectiles on a ladder-like target. While the game is entertaining and challenging, it suffers from the disadvantage of being rather large and bulky.

It would be beneficial if any large and bulky components of the tossing game were collapsible and/or foldable for easy storage or transport, while still providing a stable platform for game-play.

SUMMARY OF THE INVENTION

The present invention teaches certain benefits in construction and use which give rise to the objectives described below.

The present invention provides a target for use in a tossing game, the target having a pair of base members attached to a collapsible ladder assembly with a pair of hinge joints. Each of the pair of base members includes a pair of side members. The collapsible ladder assembly is fixedly attached to and extends upwardly from the pair of hinge joints. The ladder assembly comprises a pair of telescoping vertical members and a plurality of horizontal rungs connected therebetween. A pair of pivot pins of each of the hinge joints each hingedly connect the hinge joint to one of the side members of each of the pair of base members, such that the pair of base members can to pivot with respect to the ladder assembly between a horizontal position and a folded position. The target further includes a means for locking the pair of base members in the horizontal position with respect to the ladder assembly.

A primary objective of the present invention is to provide a target for use in a tossing game, the target having advantages not taught by the prior art.

Another objective is to provide a target that is sturdy when erected, but can be readily collapsed for easy transportation and storage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 6 is a perspective view of a; and

DETAILED DESCRIPTION OF THE INVENTION

Figure 1:
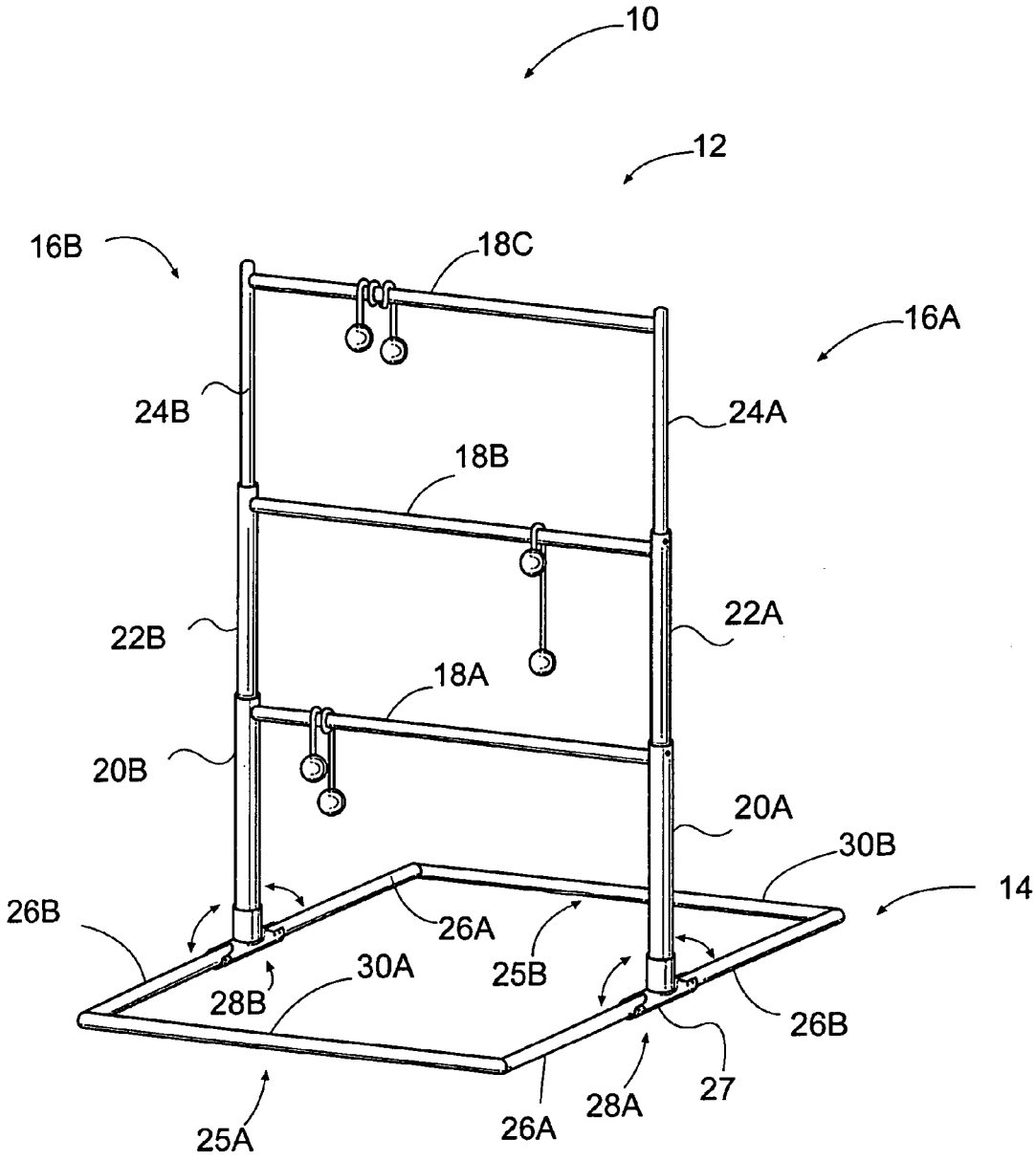
FIG. 1 is a perspective view of one embodiment of a target of a tossing game system used to play a tossing game.

FIG. 1 is a perspective view of one embodiment of a target 10 of a tossing game system used to play a tossing game. As described in more detail below, the tossing game system includes two such targets 10. Each of the targets 10 advantageously collapses for easy storage or transport. In the embodiment of FIG. 1, the target 10 includes a collapsible ladder assembly 12 attached to and extending upwardly from hinge joints 28A and 28B, which are hingedly connected to a base 14, as described in greater detail below. The ladder assembly 12 includes a pair of telescoping vertical members 16A and 16B and 3 horizontal rungs 18A, 18B, and 18C connected therebetween. As described in more detail below, each of the telescoping vertical members 16A and 16B collapses vertically and folds horizontally for easy storage or transport.

In the embodiment of FIG. 1, the telescoping vertical member 16A includes 3 telescoping sections 20A, 22A, and 24A. The section 22A fits inside of the section 20A, and slides within the section 20A from a collapsed position to an extended position. Similarly, the section 24A fits inside of the section 22A, and slides within the section 22A from a collapsed position to an extended position. As described below, push button lock connections are used to keep the sections 22A and 24A in the extended positions when the target 10 is erected as shown in FIG. 1.

In the embodiment of FIG. 1, the telescoping vertical member 16B includes 3 telescoping sections 20B, 22B, and 24B. The section 22B fits inside of the section 20B, and slides within the section 20B from a collapsed position to an extended position. Similarly, the section 24B fits inside of the section 22B, and slides within the section 22B from a collapsed position to an extended position. Push button lock connections are used to keep the sections 22B and 24B in the extended positions when the target 10 is erected as shown in FIG. 1.

In the embodiment of FIG. 1, the rung 18A is connected between upper ends of the sections 20A and 20B. The rung 18B extends between upper ends of the sections 22A and 22B, and the rung 18C is connected between upper ends of the sections 24A and 24B.

In the embodiment of FIG. 1, a lower end of each of the telescoping vertical members 16A and 16B is hingedly connected to an opposite side of the base 14. More specifically, a lower end of the section 20A of the telescoping vertical member 16A is connected to a hinge joint 28A, and a lower end of the section 20B of the telescoping vertical member 16B is connected to a hinge joint 28B.

The hinge joints 28A and 28B are adapted to hingedly connect the base 14, which preferably includes a pair of bases members 25A and 25B. Each of the base members 25A and 25B includes a pair of side members 26A and 26B connected by support members 30A and 30B, forming a generally U-shaped member. The support members 30A and 30B advantageously add structural rigidity to the base 14.

In the embodiment of FIG. 1, each of the side members 26A and 26B of the base 14 is a tube having two opposed ends. A support member 30A is connected between ends of the side members 26A and 26B a front side of the ladder assembly 12, and a support member 30B is connected between ends of the side members 26A and 26B on an opposite back side of the ladder assembly 12. The support members 28A and 28B advantageously add structural rigidity to the base 14.

In the embodiment of FIG. 1, the telescoping vertical member 16A can be vertically collapsed by sliding the section 24A into the section 22A, and sliding the section 22A into the section 20A. The telescoping vertical member 16B can be vertically collapsed by sliding the section 24B into the section 22B, and sliding the section 22B into the section 20B. The section 20A of the telescoping vertical member 16A can be folded horizontally at the hinge joint 28A, and the section 20B of the telescoping vertical member 16B can be folded horizontally at the hinge joint 28B. In the resulting collapsed position, the target 10 can be easily stored or transported.

In the embodiment of FIG. 1, the sections 20A, 22A, and 24A of the telescoping vertical member 16A, the sections 20B, 22B, and 24B of the telescoping vertical member 16B, the rungs 18A, 18B, and 18C, the side members 26A and 26B and the support members 30A and 30B of the base 14 are hollow tubes formed from a lightweight metal (e.g., aluminum). In general, the above elements may be formed from rods or tubes of any substantially rigid material.

Figure 2:
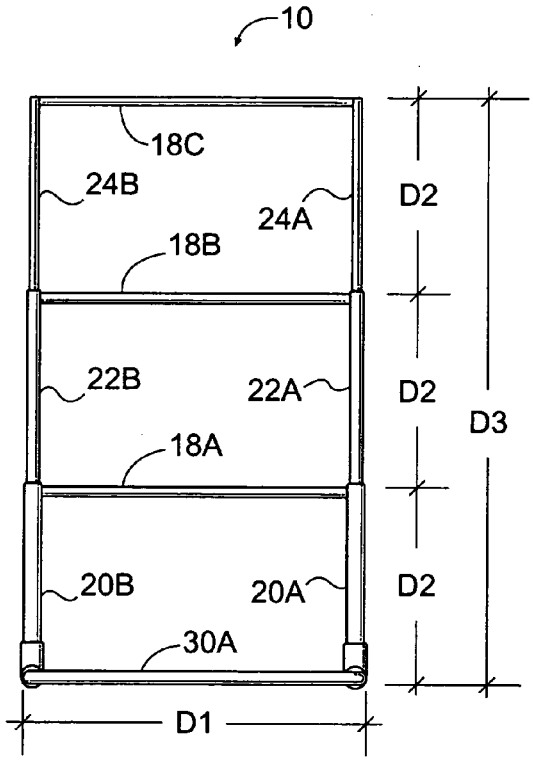
FIG. 2 is a front elevation view of the target of FIG. 1.

FIG. 2 is a front elevation view of the target 10 of FIG. 1. In the embodiment of FIG. 2, the support member 30A has a length dimension D1, which may be about 26 inches, or any other length that is suitable for game-play. A distance D2 exists between an underside surface of the support member 30A and an upper surface of the horizontal rung 18A, between the upper surface of the horizontal rung 18A and an upper surface of the horizontal rung 18B, and between the upper surface of the horizontal rung 18B and an upper surface of the horizontal rung 18C. As a result, a distance D3 exists between the underside surface of the support member 30A and the upper surface of the horizontal rung 18C. In the embodiment of FIG. 2, the distance D2 is preferably about 16 inches, and the distance D3 is preferably about 48 inches.

Figure 3:
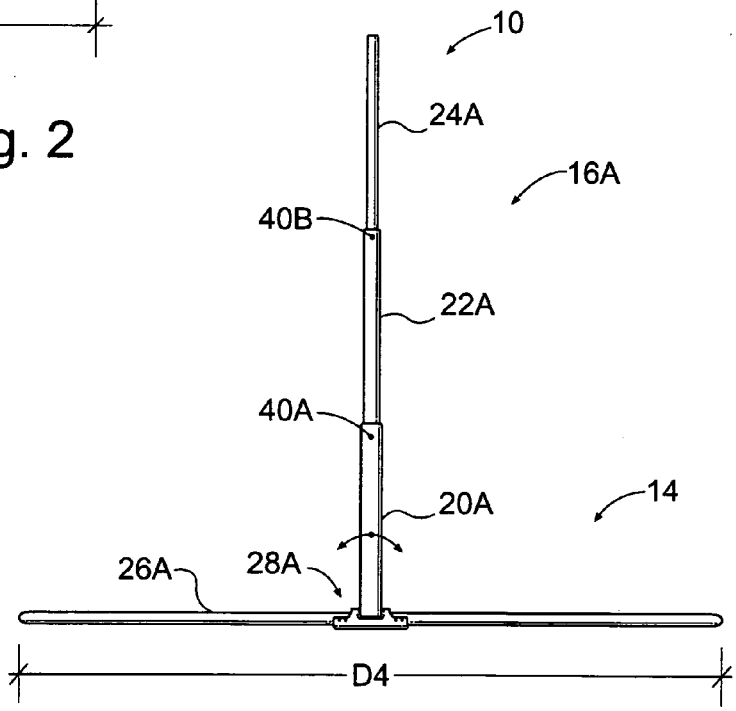
FIG. 3 is a side elevation view of the target of FIG. 1.

FIG. 3 is a side elevation view of the target 10 of FIG. 1. The side member 26A of the base 14 has a length dimension D4 that is suitable for stability during game-play, such as about 54 inches.

Also shown in FIG. 3 is the hinge joint 28A and push buttons 40A and 40B of corresponding push button lock connections of the telescoping vertical member 16A. As described above, the hinge joint 28A allows the section 20A of the telescoping vertical member 16A to be folded horizontally for easy storage or transport. The hinge joint 28A and push button 40B are described in greater detail below.

Figure 4:
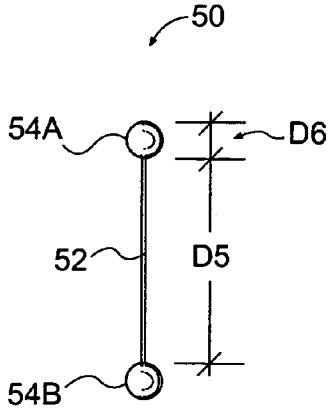
FIG. 4 is a perspective view of an object for tossing at the target of FIG. 1 during the tossing game.

FIG. 4 is a perspective view of an object 50 for tossing at the target 10 of FIG. 1 during the tossing game. In the embodiment of FIG. 4, the object 50 includes a piece of string or rope 52 having a first ball 54A connected to one end and a second ball 54B connected to an opposite end. As described in more detail below, the tossing game system preferably includes 6 such objects 50: 3 white objects 50 and 3 black objects 50.

In general, the string or rope 52 is highly flexible and does not stretch appreciably (i.e., is inelastic). In one embodiment, the string or rope 52 is a piece of nylon rope having a diameter of ⅛ (0.125) inch. In general, the balls 54A and 54B are substantially spherical and made of a substantially rigid material (e.g., hard rubber). Referring back to FIG. 1, three of such objects are shown hanging over the rungs 18A, 18B, and 18C of the ladder assembly 12.

In the embodiment of FIG. 4, the string or rope 52 has a length dimension D5 and the balls 54A and 54B have a diameter D6, wherein D5 is about 16 inches and D6 is approximately 2 inches.

Figure 5:
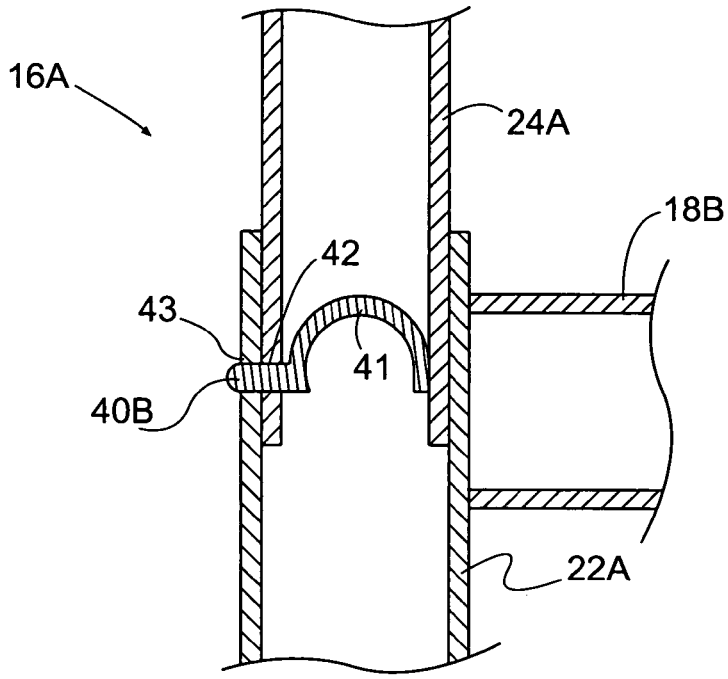
FIG. 5 is a sectional view of the target, illustrating a push pin used to lock the target in the position.

As shown in FIG. 3, each of the telescoping vertical members 16A and 16B includes push buttons 40A and 40B. As shown in FIG. 5, the push button 40B is biased outwardly with a spring 41 to extend through both the first section 24A and the second section 22A for keeping the first section 24A in the extended position. The spring 41 allows the push button 40B to be pushed out of the second section 22A, thereby enabling the telescoping vertical member 16A to be returned to the collapsed position. When the push button 40B fits through a first aperture 42 of section 24A, and a second aperture 43 of section 22A, the sections 22A and 20A are locked together. The section 22A may be retracted into the section 20A by depressing the push button 40B and sliding the section 22A into the section 20A.

When the target 10 is in the extended position, as shown in FIG. 3, the push button 40B extends from a corresponding hole in the section 22A as shown in FIG. 3. When the push button 40B fits into the hole, the sections 24A and 22A are locked together. The section 24A may be retracted into the section 22A by depressing the push button 40B and sliding the section 24A into the section 22A. The telescoping vertical member 16B preferably has similar push button lock connections.

Figure 6:
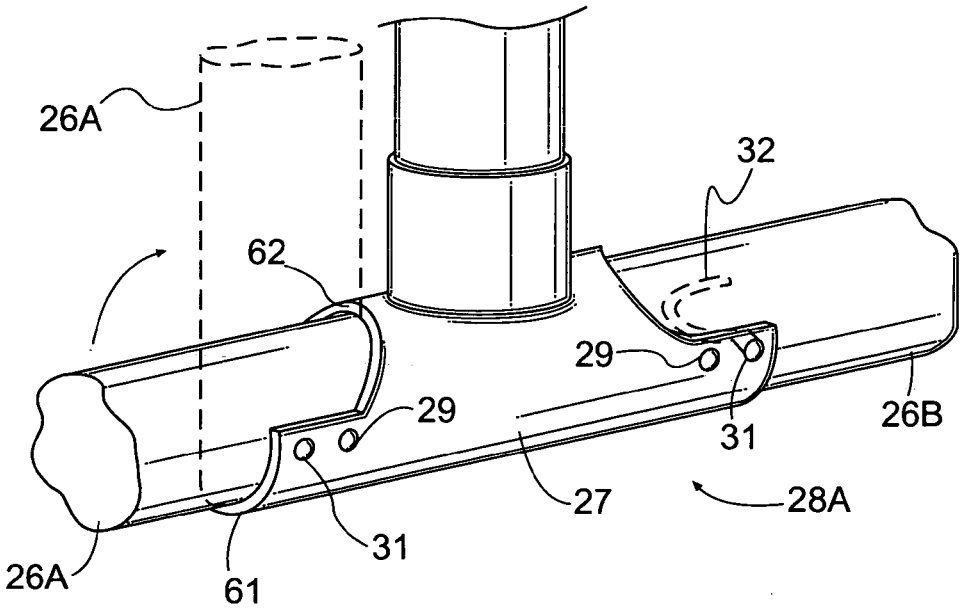

As shown in FIG. 6, the hinge joint 28A preferably includes a joint housing 27 that hingably connects the ladder assembly 12 to the base 14. The joint housing 27 is preferably fixedly attached to ladder assembly 12, and hingably attached to the base 14 with a pivot pin 29 that enables the base 14 to pivot with respect to the ladder assembly 12 between a horizontal position and a folded position. Obviously, those skilled in the art will recognize that equivalent pivoting elements could also be used in the place of the pivot pin 29, such as a post adapted to fit into an aperture or dent shaped portions in the joint housing 27, screws, pins, or any number of equivalent mechanisms, and the term "pivot pin" is hereby expressly defined to include such equivalent and/or obvious variations.

The target 10 preferably also includes a means for locking the ladder assembly 12 in the horizontal position with respect to the base 14. The means for locking may include a push button 31 biased outwardly with a spring 32 to extend through both the ladder assembly 12 and the base 14 and/or the joint housing 27 for keeping the base 14 in the horizontal position. The spring 32 allows the push button 31 to be pushed out of the joint housing 27 and thereby enabling the base 14 to be returned to the folded position. Obviously, the relationship between the joint housing 27 and the base 14 could be reversed, in which case the operable position of the push button 31 would be reversed, and such a reversal of relationships should be considered within the scope of the claimed invention.

As shown in FIG. 6, the hinge joints 28A and 28B are adapted to, together, hingedly receive the pair of base members 25A and 25B. One of the side members 26A engages one end of the hinge joint 28A, and another of the side members 26B engages the other side, preferably with a pivot pin 29. The pivot pin 29 enables each of the pair of bases members 25A and 25B to be folded up and against the telescoping vertical members 16A and 16B.

Each of the hinge joints 28A and 28B preferably includes a pair of opposing outwardly extending sidewalls 61 that each supports one of the side members 26A or 26B (of the base members 25A and 25B, shown in FIG. 1) in the horizontal position. Each of the hinge joints 28A and 28B preferably further includes a pair of concave recesses 62 that each receives one of the side members 26A or 26B when they are in the folded position.

Figure 7:
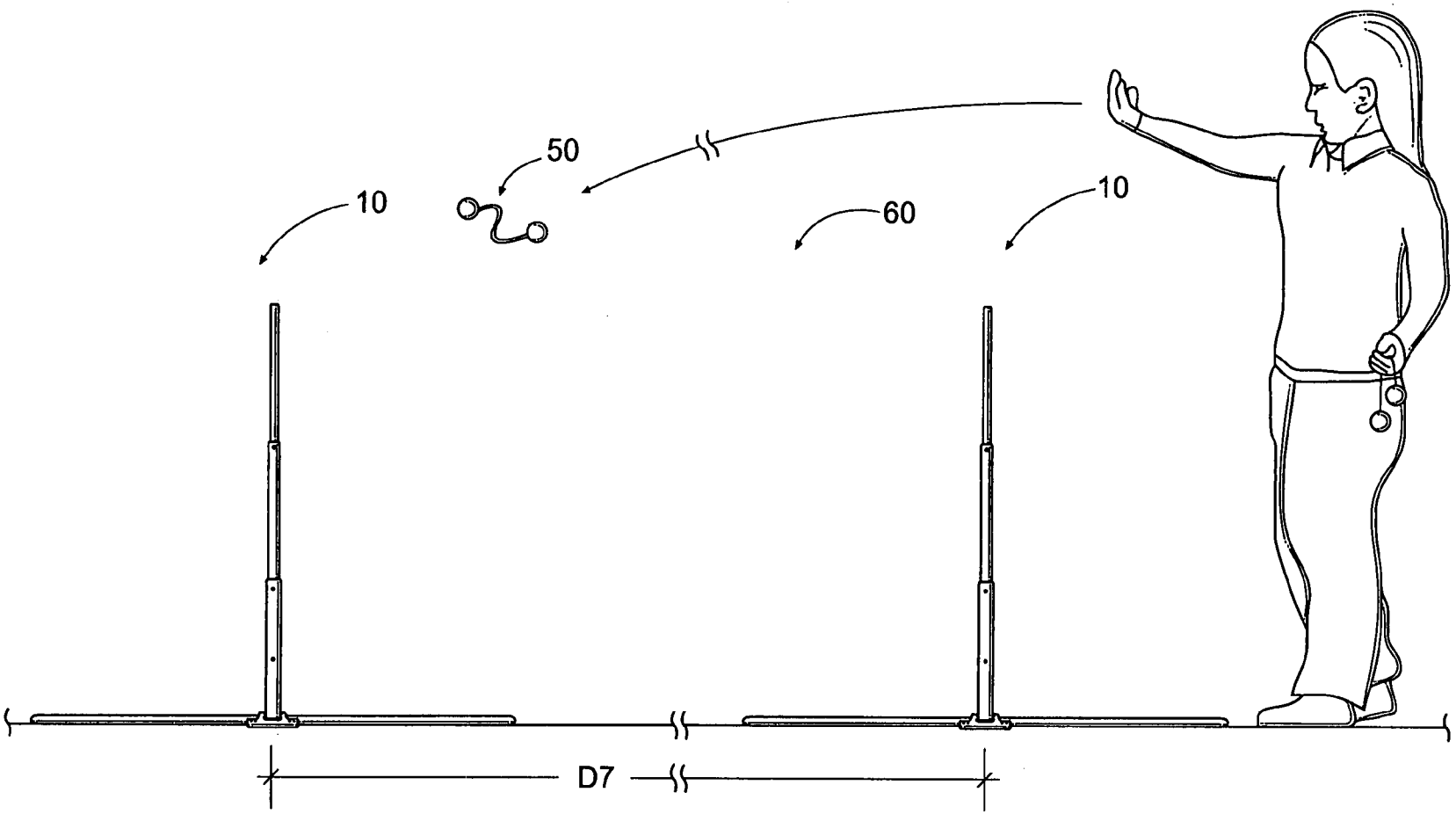
FIG. 7 is a side elevation view of a tossing game system including two of the targets of FIG. 1 and the object of FIG. 4.

FIG. 7 is a side elevation view of a tossing game system 60 including two of the targets 10 of FIG. 1 and the object 50 of FIG. 4. More specifically, the tossing game system 60 includes 6 objects 50 as described above: 3 white objects 50 and 3 black objects 50. In the embodiment of FIG. 5, the two targets 10 are spaced apart from each other by a distance D7 which is sufficiently great to challenge the throwing ability of the participants.

FIG. 7 will now be used to describe how the a tossing game system 60 is used to play one embodiment of a tossing game. The tossing game is played by an even number of players (2, 4, 6, . . . ). When the game is played by two players, one player gets the 3 white objects 50, the other player gets the 3 black objects 50, and both players start together at one of the targets 10.

When the game is played by more than two players, the players divide into two teams of equal numbers. One team gets the 3 white objects 50, and the other team gets the 3 black objects 50. Each team starts at a different one of the targets 10.

A first player, selected arbitrarily, tosses one of the objects 50 at the farthest target 10. When there are two players, the two players alternate at tossing the objects 50 at the farthest target 10. When there are more than two players, players from each team alternate at tossing the objects 50 at the farthest target 10.

When tossing one of the objects 50, each player must stand within 3 feet of the nearest target 10, and may not walk from one side of the nearest target 10 to the other in front of the nearest target 10 (i.e., may not cross over in front of the nearest target 10). When a player on one team is tossing an object 50 at a target 10, players on the opposing team will move at least 10 feet from the target 10.

For a player to score one or more points, a tossed object 50 must remain on the horizontal rungs of the target 10 (i.e., rungs 18A, 18B, and 18C in FIG. 1). The top rung (i.e., the rung 18C) scores 3 points, the middle rung (i.e., the rung 18B) scores 2 points, and the bottom rung (i.e., the rung 18A) scores 1 point.

If a player knocks an object 50 of the opposing team off of a horizontal rung of the target 10, the player scores the corresponding points, and the corresponding points are deducted from the score of the opposing team.

A player/team may win the game by: (i) scoring 7 points before the opposing team scores any points, or (ii) being the first player/team to score 21 points.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A target for use in a tossing game, the target comprising:

a pair of base members, each of the pair of base members having a pair of side members;

a pair of hinge joints;

a collapsible ladder assembly fixedly attached to and extending upwardly from the pair of hinge joints, wherein the ladder assembly comprises a pair of telescoping vertical members and a plurality of horizontal rungs connected therebetween;

a pair of pivot pins of each of the hinge joints, each of the pivot pins hingedly connecting the hinge joint to one of the side members of each of the pair of base members, such that the pair of base members can pivot with respect to the ladder assembly between a horizontal position and a folded position; and a means for locking the pair of base members in the horizontal position with respect to the ladder assembly.

2. The target as recited in claim 1, wherein each of the hinge joints includes a pair of opposing outwardly extending sidewalls that each supports one of the base members in the horizontal position.

3. The target as recited in claim 1, wherein each of the hinge joints includes a pair of concave recesses that each receives one of the base members in the folded position.

4. The target as recited in claim 1 wherein the means for locking includes a push button biased outwardly with a spring to extend through both the hinge joint and one of the pair of base members for keeping the base members in the horizontal position, the spring allowing the push button to be pushed out of either the hinge joint or the base member and thereby enabling the base member to be returned to the folded position.

* * * * *